United States Patent [19]

Lucas

[11] 4,111,304

[45] Sep. 5, 1978

[54] CARTRIDGE HAVING INDIVIDUAL ISOLATED CELLS

[75] Inventor: Bernard Lucas, Rouen, France

[73] Assignee: Padeg A.G., Moehlin, Switzerland

[21] Appl. No.: 818,730

[22] Filed: Jul. 25, 1977

Related U.S. Application Data

[63] Continuation of Ser. No. 620,498, Oct. 7, 1975, Pat. No. 4,053,054.

[51] Int. Cl.[2] ..... B65D 25/08

[52] U.S. Cl. ..... 206/534; 206/568; 206/538; 206/459; 422/64; 222/541

[58] Field of Search ..... 206/534, 538, 459, 532, 206/557, 219, 568; 116/121; 220/20, 21; 141/130, 284; 23/253 R, 253 A; 222/541

[56] References Cited

U.S. PATENT DOCUMENTS

| | | | |
|---|---|---|---|
| 2,305,204 | 12/1942 | Smith | 222/541 |
| 2,953,242 | 9/1960 | Sharn | 206/534 |
| 3,192,968 | 7/1965 | Barouch | 141/284 |
| 3,334,731 | 8/1967 | Dale | 206/538 |
| 3,540,858 | 11/1970 | Rochte | 23/253 R |
| 3,554,704 | 1/1971 | Ushakoff | 23/253 R |
| 3,554,705 | 1/1971 | Johnston | 206/219 |
| 3,617,222 | 11/1971 | Matte | 23/253 R |
| 3,644,715 | 2/1972 | Halderith | 23/253 R |
| 3,942,952 | 3/1976 | Atwood | 23/259 |
| 3,986,834 | 10/1976 | Steinbrink | 206/219 |

*Primary Examiner*—Herbert F. Ross

*Attorney, Agent, or Firm*—Haseltine, Lake, & Waters

[57] ABSTRACT

A cartridge having a plurality of distinct cells and a support to which the cells are connected so as to be disposed around a common center. At least one reference mark is placed on the package to establish the contents of the cell in a determined order in one or more sequences and at least one second mark is provided for determining the position of the cells with respect to a fixed point. In use, the marks are read by a reading device and, depending upon a selection which is made, a particular cell is perforated to allow the contents thereof to be distributed.

9 Claims, 7 Drawing Figures

FIG. 1
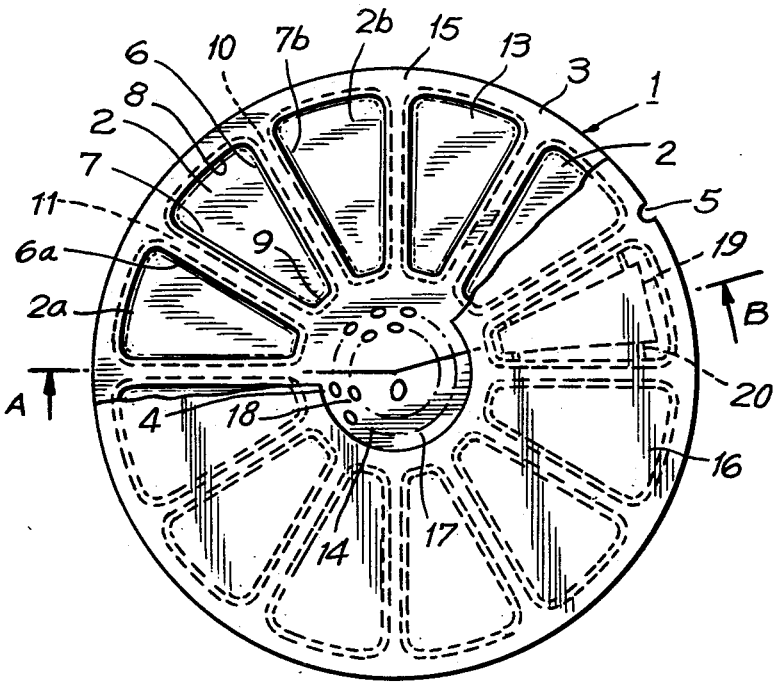
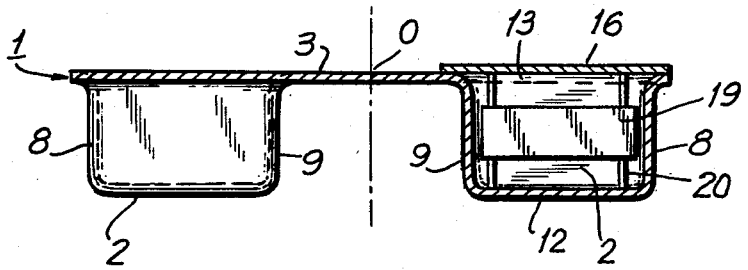
FIG. 2

CARTRIDGE HAVING INDIVIDUAL ISOLATED CELLS

CROSS RELATED APPLICATION

This Application is a continuation in part of Ser. No. 620,498 filed Oct. 7, 1975 now issued as U.S. Pat. No. 4,053,054.

FIELD OF THE INVENTION

The present invention relates to a cartridge or package having cells for diverse products, such as food products or chemical products, and particularly for products adapted for photographic uses.

BACKGROUND

The development of photographic sensitive surfaces (black and white, color, negatives, slides etc) is made in machines which carryout operations corresponding to a particular process which requires placing the photographic surface into contact with different liquid chemical products and water.

The problem of development therefore is concerned with chemical factors and mechanical factors.

Solutions to this problem have hertofore been pursued in which the chemical factors have been considered as constant which implies that the photographic surfaces are of a single type. Consequently, it is simple to realize automatic machines which effect repetitive and identical operations.

The existing machines are complex, cumbersome and costly because they are generally destined for professional laboratories.

They comprise large separate reservoirs for each chemical in a transfer mechanism on which can be affixed a more or less great quantity of photographic surfaces and which transport these photographic surfaces from one reservoir to another in a fixed order for a predetermined time in each reservoir.

Thus, a laboratory has a machine for the development of negatives in black and white, another machine for slides in black and white, another machine for negatives in color, another machine for slides in color, etc.

Certain machines are more or less multi-functional and have an adaptable operation. They are controlled either by hand, or by a program (punch card, magnetic band and the like) to adapt their operation to the type of photographic surface to be treated.

However, in all cases, these machines have great capacity (several hundreds of films per hour) and it is not feasible to employ one machine for only one or two films.

However, there are a number of cases where a user only needs to develop a small number of films, such as:

- Professional fashion or news photographers whose production is always small but extremely urgent.
- Doctors or surgeons whose treatment is a function of photographic results (not to be confused with X-rays whose development is immediate).
- Companies working for national defense and who cannot disclose their work to the general public for secrecy reasons.
- Advertising agencies, magazines, newspapers which have need for special work (unusual decorative effects) and under urgent conditions.
- Amateurs for whom the time of development is an impediment to the taking of photographs.

For example, an American tourist who gives his pictures to be developed in Paris will only have his prints several days later. If he returns to the United States a month later after having subsequently visited Italy he could only have his photos upon his return to the United States, assuming he wishes to avoid the risk of loss by having them sent to one or more hotels that he would be at during this trip.

For these people there only exist non-automatic machines which it is necessary to supervise minute by minute and under the conditions known to a skilled workman. By way of example, reference can be made to machines which do not prepare chemical products. It is necessary therefore to successively introduce six or seven different products there that one prepares manually in receivers and certain of which must be at an extremely precise temperature (± about 1/10° centigrade). All this is so complicated that ultimately these machines are operated by specialists who are employed by the owner and one is therefore faced with the preceeding problems viz., waiting time, possibility of loss, deficiency of treatment, price etc.

In sum, the technical problem is to provide apparatus by which small numbers of photographically sensitive surfaces of all possible types can be developed by means of a single automatic machine which can be utilized by anybody, even one without any special comptency.

Up to the present there only exists a single such machine. It is described in Applicant's U.S. Pat. No. 3,550,520. This machine has a number of deficiencies however.

The machine is of robot type and it responds to programmed orders provided on the package. But this package is linear and can only serve for the development of a single type because:

- the cells have a spacing variable depending on the duration of treatment of each product,
- the number of cells is variable according to each treatment,
- the length of each program package can reach an unacceptable value,
- for each treatment it is necessary to provide a package of different length and different cell configuration and, therefore to dispose as many molds and filling machines as there are different treatments, the package must be displaced linearly in very precise guides with a complex drive mechanism which leads to high price or insufficient reliability.

The present invention seeks to provide a package which is applicable to a multi-functional automated machine. The machine can effect all the necessary operations for developing all types of photographic surfaces. The machine follows a fixed program on the package which contains the products desired for one given type of photographic surface, therefore a single universal machine is operative with packages adapted to each type at development desired.

SUMMARY OF THE INVENTION

The object of the package according to the invention is to assure the transport and conservation of determined quantities of products, identical or different, introduced into the cells of the cartridge or package, the contents of each cell being isolated and separately utilized.

Not only does the package according to the invention serve for transport and simple storage, but it is also particularly adapted for use in automatic distributing and/or utilization machines for one or more products contained in the package. In addition, the package can be provided with means effecting, according to a program, the distribution and/or the utilization of these products.

The invention further contemplates certain additional means mentioned hereafter and employed at the same time as the arrangement described hereinabove.

The invention contemplates, more especially, certain modes of application and the realization thereof. It contemplates, even more particularly, new industrial products, packages with cells of the type in question, the assembly containing them as well as the elements and tools proper for their establishment.

In accordance with the invention:

All the cells are grouped in a circle.

All the cells are identical and equally spaced.

The package is placed on a turnable drum. The drum is driven and not the package itself. A single mold is sufficient for the manufacture of a single type of package. These packages are distinguished from one another by the products placed in the interior of the packages and by the program applied to it. Of course, visible indicia are printed clearly on the package in order that the user will not make an error.

The package according to the invention therefore, has a circular form. The cells are all separated such that in the machine they can all be put into contact with spaced heating elements. In practice, hot water circulates in the interior of radial partitions which are placed between the cells.

If for example, the package has twelve cells they can be filled as follows:

For development of colored slides, it is necessary to have six chemical products. One could then provide a first series of six cells for one treatment and a second series of six other cells for a second treatment; for development of black and white negatives, three chemical products are necessary and therefore three cells are required. Each package would then be filled to carry out development of four negatives.

For a special treatment (which now exists or which could be invented in the years to come) let us assume that eight chemical products would be necessary and therefore eight cells are required. Then each package could only serve for a single use and eight cells would be filled and four would be empty and non-utilized.

By way of example, and to facilitate the comprehension of the invention, there is given hereafter a description of particular embodiments of the invention shown in schematic manner and non-limitating fashion in the attached drawings.

BRIEF DESCRIPTION OF THE DRAWING

FIG. 1 is a plan view of a cartridge with cells according to the invention, the cover of the cartridge being partially broken away.

FIG. 2 is a section taken in FIG. 1 along line A-0-B.

DETAILED DESCRIPTION

Figure 3:
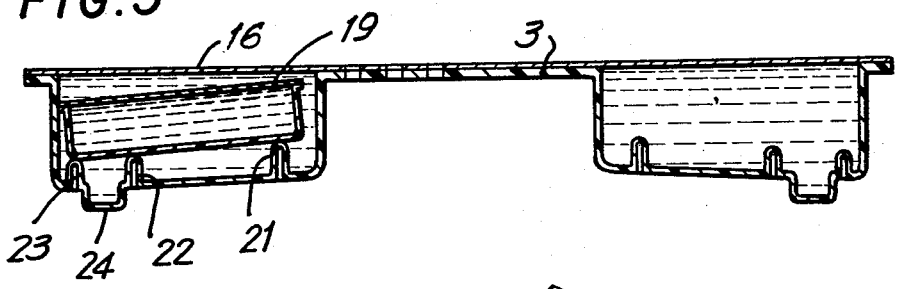
FIG. 3 is a diametric sectional view of the cartridge in FIG. 1 according to another embodiment.

According to the invention, the cartridge or package 1 comprises, on the one hand, distinct cells 2, and on the other hand, a support 3 to which the cells are connected to be disposed around a common center 0. The support 3, which in the particular embodiment is a circular plate, comprises at least one reference mark such as 4 capable of determining the disposition of the cells in a determined order in one or a plurality of sequences, as well as a second mark such as 5 capable of determining the position of the cells with respect to a fixed point.

In the illustrated example, the cells 2 are formed as hollows below the flat support 3. The cells when viewed in section parallel to the surface of the support form a curved trapezoid bounded by two radial lines 6 and 7 and two circular arcs 8 and 9 centered on an axis perpendicular to the support 3 passing through the common center 0. The radial walls corresponding to the radial lines 6 and 7 of a cell are separated by a radial space 10 or 11 of adjacent radial walls *7b* and *6a* of neighboring cells *2b* and *2a*, situated on opposite sides of the cell 2.

Each cell is closed at its lower end by a bottom wall 12 parallel to the flat support 3 or inclined with respect thereto. The side walls and the bottom of the cells are sealed, each cell having an opening 13 opposite its base. In the illustrated embodiment, all of the openings 13 are in the plane of support 3, the totality of the package 1 constituting a substantially cylindrical body with radial cells defined between an internal zone 14 and a peripheral zone 15.

The package 1 can have a variable number of cells 2 whose angular distribution can be uniform or not. Sections taken parrallel to the surface of the support 3 of the cells can be either equal or not and the same is true of the depth of the cells. One cell can be subdivided to form at least two compartments separated by a partition.

The openings 13 of the cells are closed by one or a plurality of connected closure members, for example, by a cover 16 common to all of the cells, sealed on the surface of the flat support 3. The closure member need not extend into the internal zone 14 of the package and thus can form, for example, a circular ring as shown in the drawing.

The products to be packaged, identical or different, are placed in the cells 2 either directly in the cell or in the compartments of the cell or in one or a plurality of sealed chambers, such as 19, placed in the cell and positioned in sealing manner by the projecting portions 20, these chambers constituting another form of compartment for the cell.

The removal of the products contained in one cell of the package is effected according to the nature of the products and the utilization thereof by tearing the closure member, such as the cover 16, or by forming openings in the bottom wall 12 of the cell and the portion of the closure member such as the cover 16 corresponding to this cell, or by forming openings in the circular walls corresponding to the arcs of the circles 8 and 9. The sealed chambers such as 19 can also be provided with openings closed by a closure member.

The openings in question can be provided in advance and closed by an obturation member which is pierced or torn at the proper time. These openings can also result from the perforation of the bottom wall 12 of the cell or of the portion of the corresponding closure member or of the perforation of the circular walls corresponding to the arcs of the circles 8 and 9 of from the perforation in the chambers 19 if they exist.

The package according to the invention can be formed with the exception of its one or more closure members and the chambers 19, from a single element by molding or forming an appropriate material, such as, cardboard, metal sheets and particularly by molding a plastic material such as polystyrene, or a composite product.

It is also possible to effect the formation of the cells 2 in the form of individual sealed volumes enclosing the desired products, these cells being then fixed, by any known suitable means, such as adhesives, to the flat support 3.

At least one of the walls of the cells can have an exterior surface provided with projections and depressions.

One of the characteristics of the package according to the invention is that it comprises at least one first index or reference mark capable of determining the placement of the cells in a determined order and in one or more sequences, as well as at least one second reference mark capable of determining the position of the cells with respect to a fixed point.

These reference marks can be constituted by readable inscriptions exposed to view or to photoelectric cells, by perforations, notches, magnetic inscriptions, or other known means which can be scanned, detected and exploited mechanically or electrically, permitting thus the particular utilizations of the package and specifically according to a program. The realization of such program is particularly simplified by reason of the circular form of the package which permits convenient rotation thereof around an axis passing through its center 0.

The reference mark capable of determining the placement of the cells (mark 4) can be situated in the vicinity of the common center 0, but it could also be situated at the periphery of the package. This reference mark can be situated on a cell.

The mark capable of determining the position of the cells is eccentric with respect to the center of the package. It can, as is the mark 5, be situated at the periphery of the package and be provided on the support 3. It can also be provided on a closure member of the cells such as the cover 16. This mark can also be constituted by a portion of the support which remains visible after placement of a closure member on the cells.

In the illustrated embodiment in FIGS. 1 and 2, the radial spaces such as 10 or 11 separating the cells 2 are identical. These spaces can obviously be different and can constitute the marks capable of determining the placement or the position of the cells.

The package 1 can comprise one or a plurality of marks for each cell 2, each mark being conceived as a function of the product which should be contained in the corresponding cell, the assembly of these marks constituting at least one program.

The aforementioned marks and particularly when they are in the form of optical inscriptions, perforations, notches, bosses, magnetic inscriptions, etc. are susceptible of being detected and employed in an apparatus or an arrangement receiving the package, the function of the said apparatus or arrangement being subordinated to the marks. Thus, marks, such as perforations, can be disposed on concentric circles 17, 18 having their center at 0. By turning the package around an axis passing through 0 and perpendicular to the flat support 3, the marks disposed on the circles 17, 18 control the diverse functions of the apparatus or the arrangement receiving the package.

Figure 6:
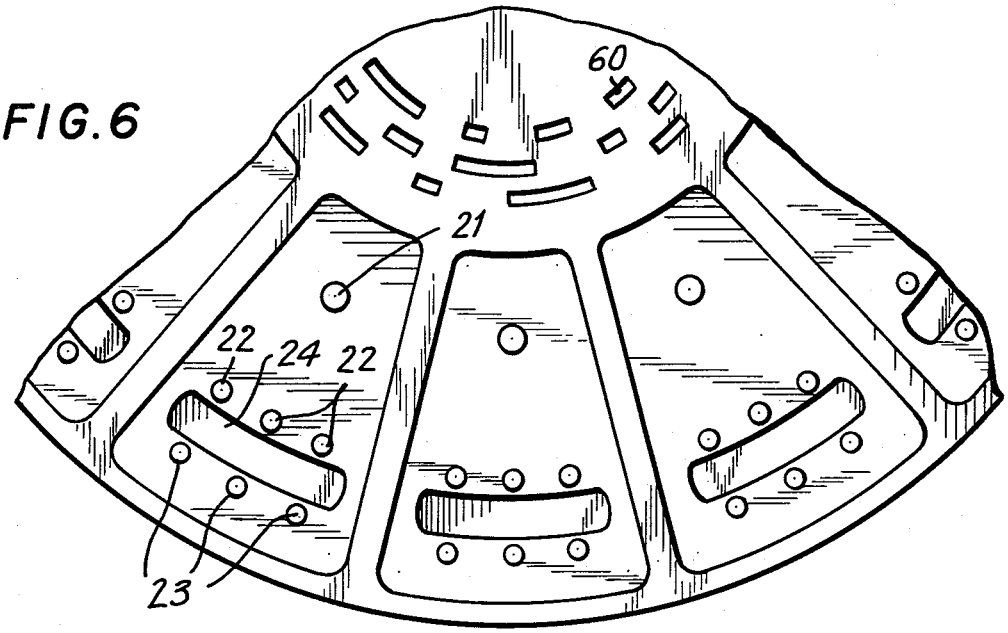
FIG. 6 is a plan view of a portion of the cartridge of FIG. 3 with the cover removed and with the cells empty.
Figure 7:
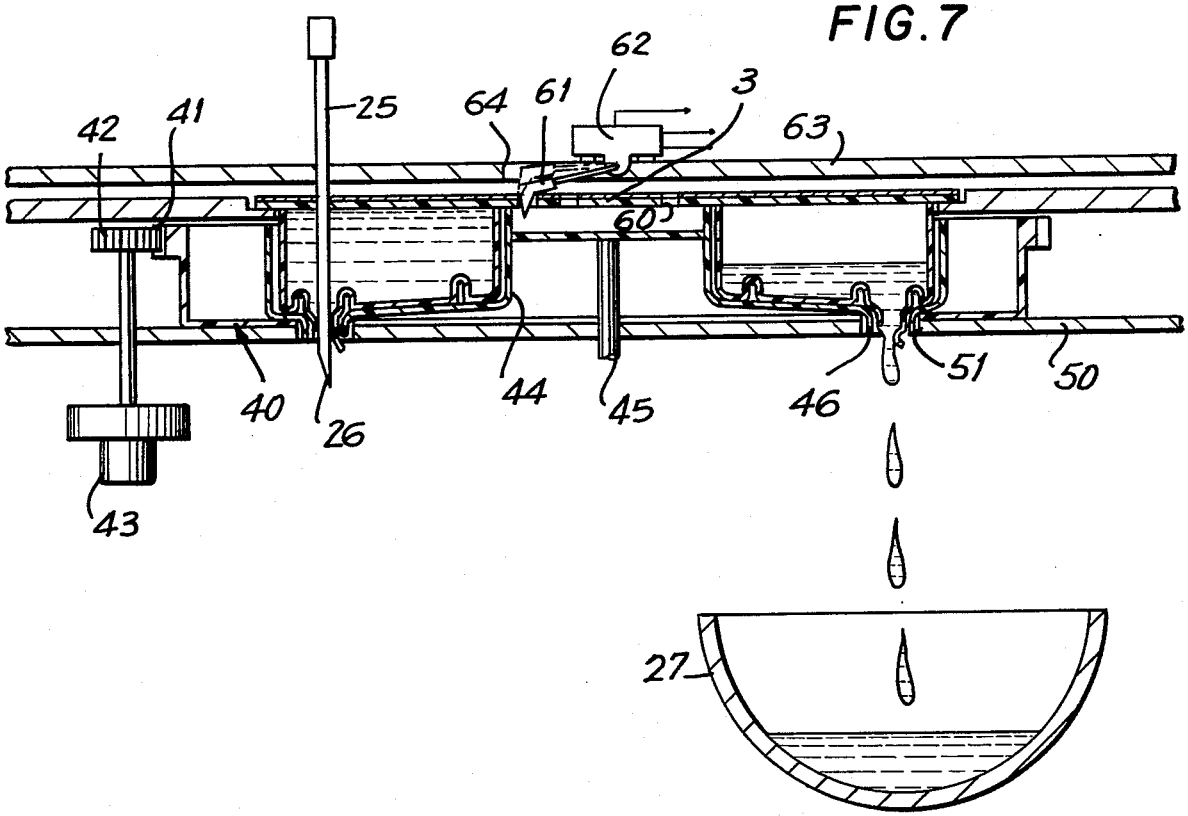
FIG. 7 is a transverse sectional view through the cartridge showing the operation thereof.

Referring to another embodiment as shown FIGS. 3 and 6 herein it is seen that the bottom wall of each cell contains a modification of the projections as seen in FIG. 2. More specifically, it is seen that there is a single projection 21 in the inner region of each cell and two rows of outer projections 22 and 23. The sealed compartment 19 rests on the projections 21, 22, and 23 such that it occupies an inclined position as shown in FIG. 3. The cell is provided with a recess 24 which is disposed between the rows of projections 22 and 23. The liquid in the cell completely fills the same in the region remaining external of the sealed compartment. Consequently, each cell contains two separate chambers i.e. sealed compartment 19 and the chamber constituted by the remaining volume of the cell in which the compartment 19 is placed. In operation, a perforator 25 having a sharp edge 26 is operated to be lowered into an active position as shown in FIG. 7 so that it first pierces the cover 16 and then it penetrates through the recess 24 in the bottom wall of the cell to form an outlet thereat from which the liquid can be dispensed into a receiver 27 for treatment of material such as photographic slides therein. In the case where two separate liquids are to be combined, at the time of utilization, cartridge 19 will be placed in line with the perforator 25 and will undergo piercing at the same as the cell in which it is contained. The inclined relation of compartment 19 facilitates the flow of liquid therefrom to the outlet orifice at recess 24.

Figure 5:
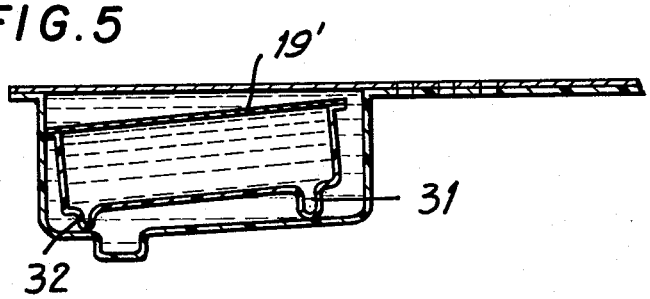
FIG. 5 is a sectional view through a cell of the cartridge according to a modification thereof.

In a modification as shown in FIG. 5 the projections 21, 22 and 23 are omitted from the bottom of the cell and instead projections 31 and 32 are formed on the bottom of compartment 19' in order to maintain such compartment in inclined position on the bottom wall of the cell.

Figure 4:
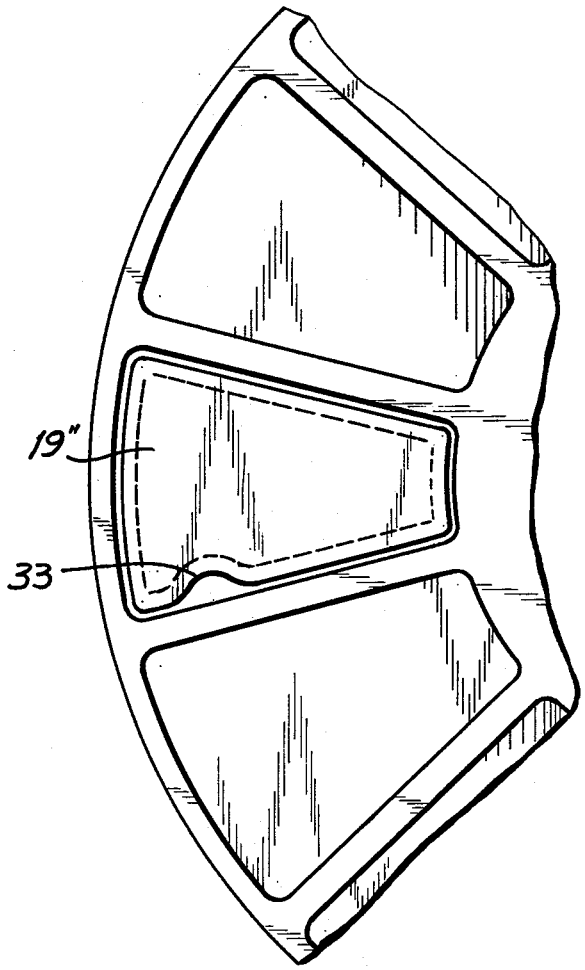
FIG. 4 is a plan view of a portion of the cartridge showing a modification thereof.

It is to be understood that the use of compartments containing one chemical product and the use of the cells containing a second chemical product is employed when the chemical products form an unstable mixture which could not be readily stored for long periods of time. Thus the components are separately stored and ultimately combined at the time of use when the perforator 25 pierces both compartments. It is necessary for the two liquids to be brought together immediately at the outlet of the cell of the container and in this regard the projections either at the bottom of the compartment or on the bottom wall of the chamber define a space between the bottom of the cell and the bottom of the compartment to leave a free passage for flow of the products outside the sealed compartment 19. In a further arrangement a lateral recess 33 can be provided in the side wall of the compartment 19'' as shown in FIG. 4 to leave free passage for the products around the compartment 19''. In special cases where the products in the compartment are critical to the development of photographic material, the placement of the notch can be indicative of the particular cell in which the product is to be placed. Thus, for example, the placement of the notch in the right wall as shown in FIG. 4 can be associated with a particular cell of the cartridge and a notch can be placed in the left wall of other compartments which are associated with a different cell.

In operation, the cartridge is placed in a drum or container 40 whose outer wall carries a gear toothing 41 in mesh with a pinion 42 driven from a motor 43. The container 40 carries a cellular assembly 44 whose arrangement corresponds to that of the cartridge such that the cells of the cartridge can be inserted into the cellular arrangement 44 in the manner as evident in FIG. 7. The container is carried on a centering shaft 45 such that as the motor 43 is energized, the container will be driven in rotation about shaft 45 as a center. The cellular arrangement 44 has a series of slots 46 each positioned to receive the projection 24 at the bottom of each of the cells of the cartridge. The entire assembly is carried in a frame whose bottom wall or plate 50 is formed with a circumferential slot 51 through which projections 46 extend. In this way, soiling of the plate of the machine is avoided since no liquid can infiltrate between the underside of the container and the lower plate 50. The lower edge of projections 46 is at least at the level of the bottom surface of plate 50. In this way, even if a drop of liquid remains after emptying of a cell, it will ultimately fall below the plate 50.

In order to control the drive of the container and the operation of the perforator 25, marks form a program constituted by a plurality of holes 60 arranged in the manner as shown in FIG. 6 and adapted to cooperate with the actuator 61 of a switch 62. The switch 62 is carried on an upper plate 63 of the machine and the actuator 61 of the switch can pass through a hole 64 provided in the plate 63. The actuator either rides on a solid portion of the support 3 of the cartridge or in a hole 60 therein. A plurality of switches can be provided each associated with a respective ring of holes and connected in a suitable electronic circuit to effect the proper operation of the perforator 25 and the drive of the container with the cartridge therein. As a consequence, proper discharge of liquid from the various cells into the receiver 27 can be effected at selected moments in order to correspond with the particular development technique of the photographic materials.

The top plate 63 of the machine can be suitable pivoted so as to expose the entire upper surface for insertion of the cartridge, in the embodiment of FIG. 1 the cartridge can only be inserted into the container in one specific position.

The cover 63 can carry various elements such as timers, lights and the like in addition to the switch 62 and the perforator 25. After the cartridge has been inserted into the container, the cover is closed and the actuator of the switch will be positioned for cooperation with the holes in the respective rows according to the program.

When the motor 43 is actuated it drives the container in rotation which carries with it the cartridge and the program. The holes travel in front of the actuators of the switches and cause these to be raised when they pass on a solid portion of the package or lowered when they pass in a hole in the package, such as seen in FIG. 7 where the lowered position of the actuator is shown in solid lines and the upper position in dotted lines. Although the arrangement of the switches has been shown in the central portion of the package, it is obvious that this could also be achieved at the periphery of the cartridge. In practice it is more convenient to employ the central portion of the cartridge for cooperation with the switches as the use at the periphery of the cartridge would require a greater diameter of material. Furthermore, although mechanical switches have been shown, these could be replaced by any suitable equivalent means such as photoelectric cells, magnetic tracks and the like. In all instances, the principle remains the same insofar as the cartridge carries the program which controls the machine.

Each cartridge is employed for a particular use and after such use is dispensed with. It is not refilled after each use and therefore the material of the cartridge is relatively thin and is pierceable at the time of use in order to enable rapid outflow of the contained liquid.

As seen from the above, the cartridge contains cells which are all independent and each of which can contain respective liquid product. The cartridge also carries the information for its operation by means of the given program and this will control the machine to dispense the liquids contained in the cells in any given sequence and order. In practice, the cells are filled according to their intended use and then the corresponding program is subsequently added.

It will be seen that the invention is not limited to the embodiments and utilizations indicated and it embraces also all variations as will become evident to those skilled in the art.

What is claimed is:

1. A cartridge adapted for containing a dispensible liquid comprising a one-piece body of material defining a plurality of cells secured to one another and constituting an integral assembly, the cells being arranged in a circular array around a common center and adapted for containing a liquid, each said cell having a bottom wall, side walls and an open face, and a sheet sealably closing said open face of the cell after introduction of the liquid thereto, a support for said body including index means thereon forming a program for controlling operation of an automatic control mechanism of a machine which can carry out various operations as a function of said program whereby the operation of said machine will be subordinated to said program, said array of cells being arranged around a central region, said support being in said central region, said sheet closing all of the cells, said material of said body and said sheet being made of pierceable material and being arranged with said sheet juxtaposed on said body and located in spaced relation above said bottom wall of said cell, a sealed chamber enclosed by a perforable sheath disposed in at least one of said cells, said sealed chamber occupying less than the full volume of said one cell to leave a compartment in said cell containing said liquid, a second liquid being contained in said sealed chamber, means for positioning said sealed chamber within the cell in a stable supported position therein such that a perforator can penetrate in sequence through the sheet, said sealed chamber and the bottom of the cell to cause the liquids from the sealed chamber and the cell to flow from the bottom of the cell.

2. A cartridge as claimed in claim 1 wherein said body has a circular peripheral rim surrounding the assembly of said cells.

3. A cartridge as claimed in claim 1 wherein said sealed chamber has a lateral notch therein.

4. A cartridge as claimed in claim 1 comprising an external projection on the bottom of said cell positioned for being pierced by the perforator for constituting a discharge outlet for the liquids from the sealed chamber and cell.

5. A cartridge as claimed in claim 4 wherein said means for positioning the sealed chamber within the cell in a stable supported position comprises projection means holding said sealed chamber in said cell in a horizontally inclined position.

6. A cartridge as claimed in claim 5 wherein said projection means comprises a plurality of projections projecting internally with said cell.

7. A cartridge as claimed in claim 6 wherein said sealed chamber rests on the projections projecting into said cell.

8. A cartridge as claimed in claim 5 wherein said projection means comprises a plurality of external projections on said sealed chamber.

9. A cartridge as claimed in claim 4 wherein the bottom of said sealed chamber is inclined with respect to the horizontal and has a lower end positioned in proximity above the external projection for discharge of all the liquid in the sealed chamber through the discharge outlet.

* * * * *